US009970334B2

(12) United States Patent
Brenner

(10) Patent No.: US 9,970,334 B2
(45) Date of Patent: May 15, 2018

(54) CAMSHAFT ADJUSTER

(71) Applicant: Schaeffler Technologies AG & Co. KG, Herzogenaurach (DE)

(72) Inventor: Holger Brenner, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days. days.

(21) Appl. No.: 15/022,919

(22) PCT Filed: Jul. 15, 2014

(86) PCT No.: PCT/DE2014/200322

§ 371 (c)(1),
(2) Date: Mar. 17, 2016

(87) PCT Pub. No.: WO2015/043582

PCT Pub. Date: Apr. 2, 2015

(65) Prior Publication Data

US 2016/0230613 A1 Aug. 11, 2016

(30) Foreign Application Priority Data

Sep. 24, 2013 (DE) ..... 10 2013 219 139

(51) Int. Cl.
*F01L 1/34* (2006.01)
*F01L 1/344* (2006.01)
*F01L 1/22* (2006.01)

(52) U.S. Cl.
CPC ..... *F01L 1/3442* (2013.01); *F01L 1/22* (2013.01); *F01L 2001/34479* (2013.01)

(58) Field of Classification Search
CPC .. F01L 1/22; F01L 1/3442; F01L 2001/34479
(Continued)

(56) References Cited

U.S. PATENT DOCUMENTS 6,367,438 B2 4/2002 Neller
7,640,902 B2 1/2010 Knecht et al.
(Continued)

FOREIGN PATENT DOCUMENTS

CN 1908384 2/2007
CN 102124188 7/2011
(Continued)

*Primary Examiner* — Ching Chang
(74) *Attorney, Agent, or Firm* — Davidson, Davidson & Kappel, LLC

(57) ABSTRACT

A camshaft adjuster for adjusting the angle of rotation of a camshaft, including a stator which can be driven by a crankshaft of an internal combustion engine and which has a plurality of radially inwardly protruding stator lands, and a rotor having a plurality of vanes projecting radially outwards from a radially inner ring, and an annular gap which is provided between the stator and the rotor and which is divided by a plurality of stator lands into working chambers which are in turn divided by the vanes into pressure chambers acting in opposite directions, wherein the rotor is divided into at least two rotor parts in a dividing plane arranged perpendicular to an axis of rotation of the camshaft adjuster, wherein the dividing plane of the rotor intersects at least one pressure medium line, and the pressure chambers acting in a first direction are separated from the pressure chambers acting in a second direction by at least one seal between a first and a second end face of the two rotor parts is provided.

9 Claims, 3 Drawing Sheets

(58) Field of Classification Search
USPC ..... 123/90.15, 90.17
See application file for complete search history.

(56) References Cited

U.S. PATENT DOCUMENTS

| | | | | |
|---|---|---|---|---|
| 7,878,164 | B2 * | 2/2011 | Borraccia | F01L 1/022 123/90.17 |
| 8,490,589 | B2 | 7/2013 | Arnold | |
| 8,550,046 | B2 | 10/2013 | Terfloth et al. | |
| 9,284,862 | B2 | 3/2016 | Frey | |
| 2008/0254900 | A1 | 10/2008 | Uckfitz | |
| 2008/0289596 | A1 | 11/2008 | Borraccia et al. | |
| 2010/0154732 | A1 | 6/2010 | Bayrakdar | |
| 2013/0199479 | A1 | 8/2013 | Ottersbach et al. | |

FOREIGN PATENT DOCUMENTS

| | | | |
|---|---|---|---|
| DE | 10024760 | | 12/2001 |
| DE | 102008057570 | | 5/2010 |
| DE | 10 2009 053 600 | A1 | 5/2011 |
| DE | 102011117856 | | 5/2013 |
| EP | 1 979 582 | B1 | 9/2010 |
| WO | WO2010128976 | | 11/2010 |

* cited by examiner

CAMSHAFT ADJUSTER

The present invention relates to a camshaft adjuster.

BACKGROUND

A generic camshaft adjuster is known from EP 1 979 582 B1, for example. In its basic configuration, the camshaft adjuster includes a stator which is drivable by a crankshaft, and a rotor which is connectable to the camshaft in a rotatably fixed manner. Provided between the stator and the rotor is an annular space which is divided into a plurality of working chambers by radially inwardly projecting protrusions which are connected to the stator in a rotatably fixed manner, the working chambers each being divided into two pressure chambers by a vane which projects radially outwardly from the rotor. Depending on the action of a pressure medium on the pressure chambers, the rotor is adjusted with respect to the stator, and the camshaft is thus also adjusted with respect to the crankshaft in the "advance" or "retard" direction. The stator and the rotor of a camshaft adjuster are usually designed in one piece. A rotor is described in Published Unexamined German Patent Application DE 10 2009 053 600 A1, which for the purpose of greater ease in manufacturing is made up of multiple parts and is divided along a parting plane. In the exemplary embodiment in the publication DE 10 2009 053 600 A1, a division along a plane perpendicular to the rotation axis of the camshaft adjuster is provided.

SUMMARY OF THE INVENTION

A two- or multipart design of the rotor has the disadvantage that during manufacture, complicated processes for connecting the rotor halves are necessary in order to be able to absorb the forces which occur during operation. In addition, a two- or multipart specific embodiment results in greater axial play between the stator and the rotor, which in turn results in leakage of the pressure medium from the pressure chambers.

It is an object of the present invention to provide a camshaft adjuster which includes a rotor that is designed in multiple parts, in which the above-mentioned disadvantages are overcome.

The present invention provides that the parting plane of the rotor intersects at least one pressure medium line of the rotor, and the pressure chambers of a first direction of action are separated from the pressure chambers of a second direction of action by at least one seal between a first and a second end face of the two rotor parts. The two rotor parts, without being connected to one another beforehand, may be pushed onto a camshaft, as a result of which the complicated process of joining the two rotor parts during manufacture is dispensed with. In addition, boring of pressure medium lines, situated in the parting plane, into the rotor may be dispensed with, since they may be formed by depressions in the mutually facing end faces of the rotor parts. This may already take place during the manufacture of the rotor parts, so that a separate production step for the pressure medium lines of the rotor is dispensed with. During operation, the pressure medium lines of the rotor are acted on by pressure, thus forming a gap between the mutually facing end faces of the two rotor parts, into which pressure medium flows from the pressure medium lines of the rotor. The pressure medium thus acts on the mutually facing end faces of the two rotor parts in such a way that the two rotor parts are pushed apart in the axial direction. The first rotor part is thus pressed against a cover which is connected to the stator in a rotatably fixed manner, while the second rotor part rests axially on a shoulder of the camshaft; the axial play is thus reduced to a minimum. Due to this mechanism, the component tolerances of the components resting axially on one another may be increased, which in turn results in reduced manufacturing costs. In addition, the oppositely acting pressure chambers are sealed off from one another by the provided seal, so that leakage of pressure medium may be avoided. As a result of the seals on the mutually facing end faces of the rotor parts, the pressure medium does not flow from the pressure chambers of the one direction of action into the pressure chambers of the opposite direction of action as soon as a gap forms between the rotor parts. The original functional principle of a one-part rotor or two joined rotor parts may thus be maintained, even when a gap forms between the rotor parts.

Furthermore, it is particularly advantageous when the pressure medium lines intersected by the parting plane extend in the radial direction. A homogeneous distribution of the pressure medium on the mutually facing end faces of the rotor parts is thus ensured, resulting in a more advantageous pressure distribution.

It is further provided that the seal is formed by a labyrinth seal which extends in the radial direction. The labyrinth seal may be achieved, without using additional elements, by adapting the surface geometry. For this purpose, it is particularly advantageous to implement the labyrinth principle via intermeshing geometries at the end faces of the rotor parts. W- or V-shaped, rectangular, or wave-shaped geometries are implementable; alternatively, however, other forms of a labyrinth geometry are also conceivable in a particularly simple manner.

Moreover, it is particularly advantageous to connect the two rotor parts to one another in a form-locked manner in the rotational direction via the labyrinth seal. By using the labyrinth seal, which is present anyway, for the form-locked connection of the rotor parts, the manufacturing costs may be reduced by dispensing with additional form-locking elements. A reduction in the complexity of components is achieved by functionally integrating the seal and the form fit.

In addition, it is provided that the axial extension of the form-locked connection of the labyrinth seal is greater than the design-related maximum possible axial gap width between the two mutually facing end faces. As a result of this specific embodiment, it is ensured that, regardless of the axial position of the rotor parts, the sealing effect between the oppositely acting pressure chambers as well as the function of a form-locked connection in the rotational direction between the first and second rotor parts are maintained at all times.

Furthermore, it is particularly advantageous to provide a ring-shaped adapter between the rotor parts and the camshaft. The adapter allows a rotor according to the present invention, made up of two parts, to be connected to a conventional camshaft with a central valve. In addition, it is advantageous for the adapter to include at least two radially extending pressure medium lines, and for the pressure medium lines to be connected to the pressure medium lines of the rotor via axially extending grooves on the radially outer surface of the adapter. The adapter connects at least two pressure medium lines of the camshaft to the corresponding pressure medium lines of the rotor without having to adapt the arrangement, known from the prior art, of the pressure medium lines axially one behind the other, and without having to adapt the control of the pressure medium flow via a central valve. In addition, the axial groove then also allows the pressure medium lines of the rotor to be supplied with pressure medium when the first rotor part is axially displaced. Furthermore, the grooves may extend in the circumferential direction across the diameter of the pressure medium line of the camshaft. This results in the advantage that the adapter allows a supply of pressure medium, even when the pressure medium lines of the rotor are offset in the circumferential direction with respect to the pressure medium lines of the camshaft. Due to the mode of operation of the central valves known from the prior art, the pressure medium lines of the camshaft are situated axially one behind the other, thus establishing the minimum axial thickness of the rotor. Due to the adapter, the pressure medium lines of the rotor may be guided into a plane, as the result of which the rotor may be designed with a smaller thickness in the axial direction.

In addition, it is provided to brace the adapter on the camshaft in the axial direction by an axial central screw. The central screw is used for bracing the adapter, and may also be utilized for fixing the central valve in the camshaft.

It is particularly advantageous for the second rotor part to be axially clamped between a shoulder of the adapter and a shoulder of the camshaft, and thus be connected to the camshaft in a rotatably fixed manner. This ensures that the first rotor part may move within the design constraints, while the second rotor part is axially fixed and connected to the camshaft in a rotatably fixed manner. Due to such a support of the two rotor parts, the first rotor part may be supported in the axial direction on the second rotor part when acted on by pressure, and is thus pressed against a cover, resulting in a reduction in the axial play. In addition, a torque is transmitted between the first rotor part and the camshaft via the second rotor part, connected to the camshaft in a rotatably fixed manner, and via the form-locked connection of the labyrinth seals at the end faces. In addition, the camshaft adjuster according to the present invention has advantageous effects in controlling the system. If high pressure is applied in a pulse-like manner to the pressure medium by pressure peaks, a relative movement between the stator and the rotor takes place, depending on the position of the stator with respect to the rotor. At the same time, the outer surface of the first rotor part is pressed against the cover, which is connected to the stator in a rotatably fixed manner, by the high pressure in the gap between the mutually facing end faces of the rotor parts, resulting in an increased friction force between these components which counteracts the relative movement between the stator and the rotor which is triggered by the pressure peak; a damping effect is thus achieved.

In addition, it is particularly advantageous for a stop for the stator webs to be provided on the vanes of the second rotor part, which is connected to the camshaft in a rotatably fixed manner. Due to the stops being situated on the second rotor part, the rotational torque is transmitted directly to the camshaft. Additional stress on the form-locked connection of the labyrinth seal may thus be avoided, resulting in greater operational reliability of the camshaft adjuster.

BRIEF DESCRIPTION OF THE DRAWINGS

The present invention is described in greater detail below with reference to one preferred exemplary embodiment.

DETAILED DESCRIPTION

Figure 1:
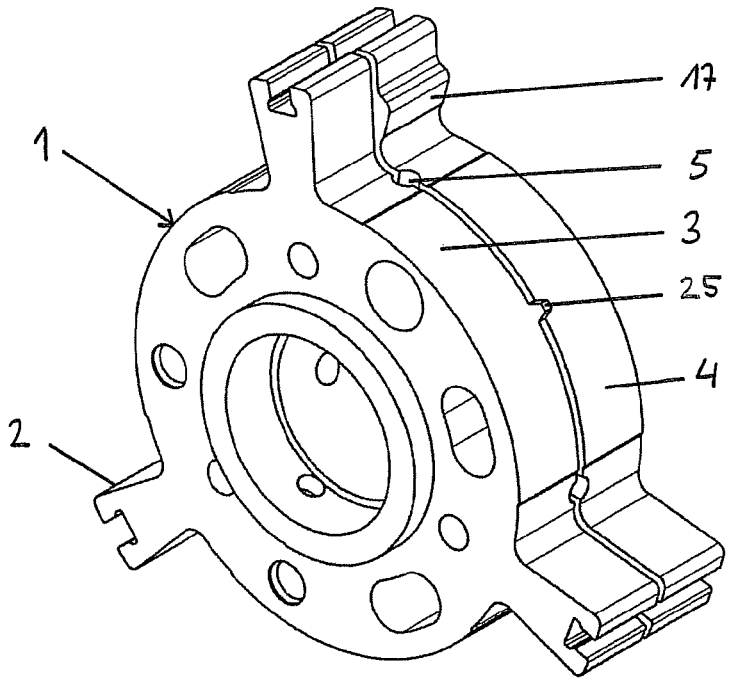
FIG. 1 shows a two-part rotor with an adapter.

A camshaft adjuster 26 according to the present invention is made up of a stator 21 which is connected to a camshaft 13 in a rotatably fixed manner, and which includes radially inwardly protruding stator webs 22. A rotor 1 which is connected to a crankshaft in a rotatably fixed manner and which includes multiple vanes 2 which protrude outwardly from a radially inner ring divides working chambers formed by stator 21 into pressure chambers 23, 24 which may be acted on by pressure medium via pressure medium lines 5 of rotor 1, as the result of which the relative angle between stator 21 and rotor 1 may be controlled in the "advance" or "retard" direction.

The operating principle of this camshaft adjuster corresponds to that of camshaft adjusters already described in the publications EP 1 979 582 B1 and DE 100 24 760 A1. The cited publications are expressly incorporated into the disclosed content of the present patent application with regard to the disclosure of the functional principle of the camshaft adjuster.

Figure 2:
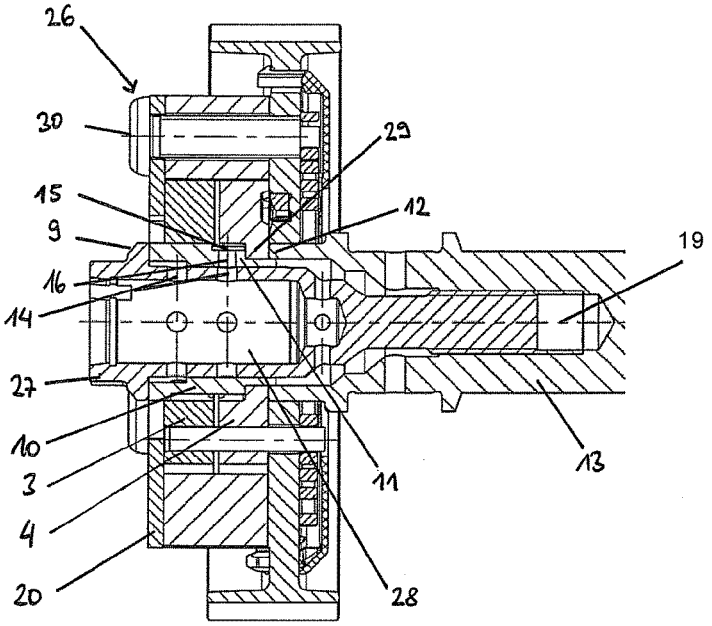
FIG. 2 shows a sectional view of a camshaft adjuster according to the present invention.
Figure 3:
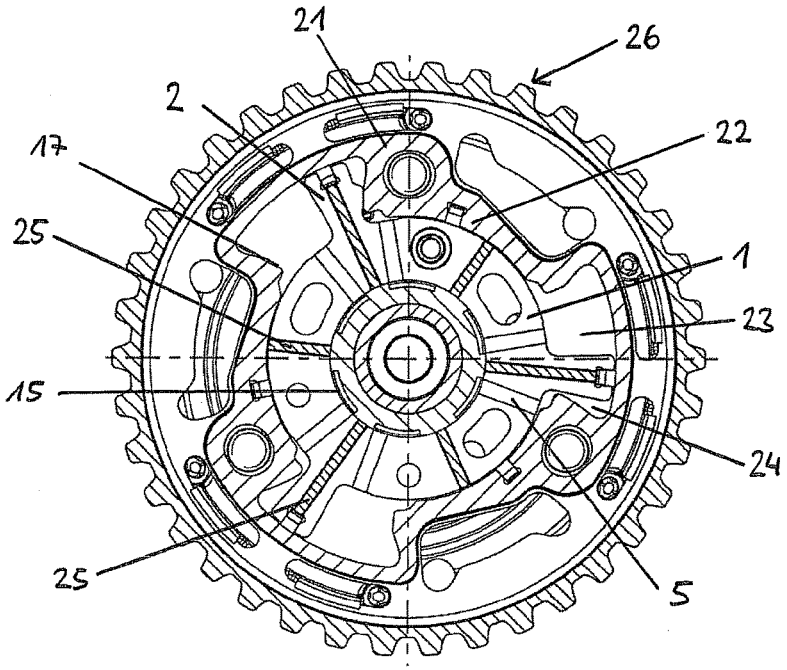
FIG. 3 shows a sectional view of a camshaft adjuster according to the present invention from another perspective.

FIGS. 1, 2 and 3 show a generic camshaft adjuster 26 with a rotor 1 made up of two rotor parts 3, 4. In this exemplary embodiment, the parting plane of rotor 1 extends through pressure medium lines 5 which open into pressure chambers 23, 24, perpendicularly with respect to a rotation axis 19 of camshaft adjuster 26. Due to the action of pressure medium on pressure medium lines 5 of rotor 1, a gap 18 between two mutually facing end faces 7, 8 of rotor parts 3, 4 fills with pressure medium. Second rotor part 4 is fixed with respect to camshaft 13 in the axial direction, and is used for supporting first rotor part 3 in the axial direction. When pressure medium lines 5 of rotor 1 are acted on by a pressure medium, rotor parts 3, 4 are pushed apart, and first rotor part 3 is pressed against a cover 20 which is connected to stator 21 in a rotatably fixed manner. To prevent pressure medium from flowing from pressure chambers 23 of one direction of action into pressure chambers 24 of the other direction of action, radially extending seals 25 are situated on end faces 7, 8 of rotor parts 3, 4, in the circumferential direction between the pressure medium lines 5 of rotor 1, and at the same time are used for connecting first rotor part 3 to second rotor part 4 in a rotatably fixed manner. Due to this operating principle, first rotor part 3 is always in a pretensioned state during operation, as the result of which the axial play may be compensated for.

FIG. 1 illustrates a two-part rotor 1 according to the present invention. Alternatively, rotors 1 made up of more than two parts are also conceivable. In this exemplary embodiment, the parting plane of rotor 1 extends perpendicularly with respect to rotation axis 19 of camshaft adjuster 26, and through pressure medium lines 5 of rotor 1. However, a division of rotor 1 in which only some of pressure medium lines 5 of rotor 1 are intersected is also conceivable. At least one stop 17 for stator webs 22 is provided on vanes 2 of first rotor part 3. Due to stop 17 on second rotor part 4, unnecessary stress on the two rotor parts 3, 4 is avoided when rotor 1 of camshaft adjuster 26 is in the maximum deflected position relative to stator 21 during operation.

FIGS. 2 and 3 show a sectional view of a camshaft adjuster 26 according to the present invention from various perspectives. A central valve 28 together with a central screw 27 is passed through a central opening of rotor 1 and screwed into camshaft 13, so that rotor 1 is subsequently braced on camshaft 13 to form a rotatably fixed combination. At least two pressure medium lines 14 (port A and port B) of camshaft 13 which may be acted on by pressure medium in opposite directions are situated axially one behind the other, and connected via an adapter 10 to pressure medium lines 5 of rotor 1, which are situated in a plane. Second rotor part 4 is braced in the axial direction on one side by a shoulder 12 of camshaft 13, and on the other side by a shoulder 11 of adapter 10, a radially inwardly situated shoulder 29 of second rotor part 4 being utilized for bracing second rotor part 4. Adapter 10 is in turn braced on camshaft 13 by a shoulder 9 of central screw 27. First rotor part 3 is pushed loosely over adapter 10, and is supported in the axial direction and also in a rotatably movable manner. The movement of first rotor part 3 is delimited in a first axial direction by second rotor part 4, and in the second axial direction by a cover 20. Cover 20 is connected to stator 21 in a rotatably fixed manner via axial fastening screws 30, and is additionally used for sealing pressure chambers 23, 24 from the surroundings.

Figure 4:
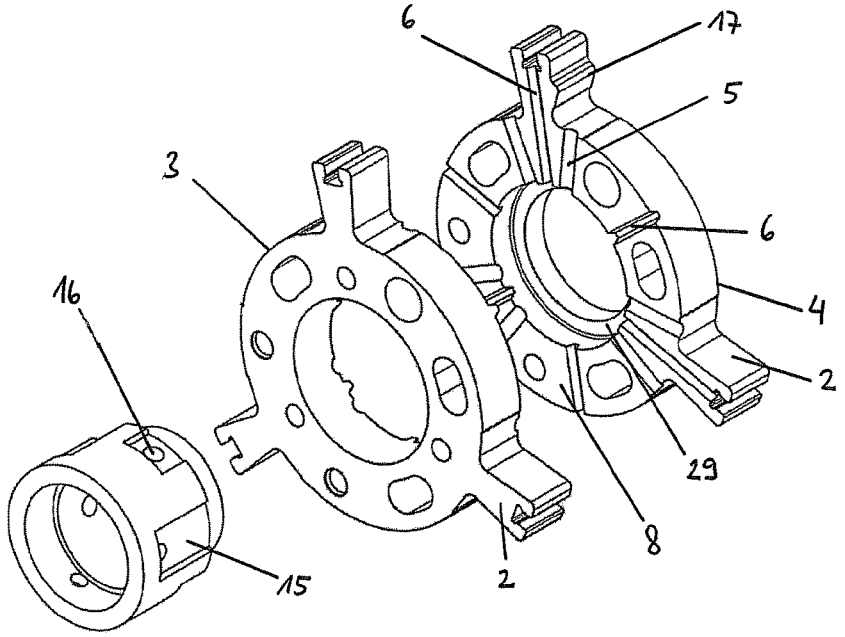
FIG. 4 shows an exploded view of a two-part rotor with an adapter.
Figure 5:
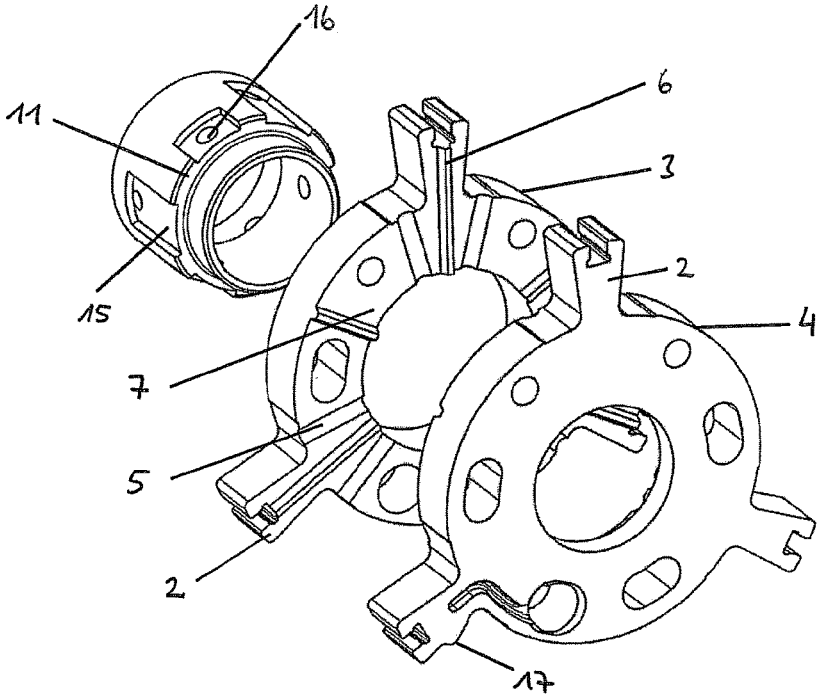
FIG. 5 shows an exploded view of a two-part rotor with an adapter, from another perspective.

FIGS. 4 and 5 show variants of an exploded view of a two-part rotor 1 with an adapter 10. In this exemplary embodiment, pressure medium lines 5 of rotor 1 extend in a plane perpendicular to rotation axis 19 of camshaft 26, and are centrally divided in a parting plane. At least one seal 25, which in this specific embodiment is designed as a labyrinth seal 6, extends in each case in the radial direction between end faces 7, 8 of rotor parts 3, 4, between two pressure medium lines 5 of rotor 1. The seal is used for sealing off oppositely acting pressure chambers 23, 24 from one another when a gap forms. Labyrinth seals 6 are formed on first rotor part 3 by a trapezoidal geometry which protrudes axially from the section plane. Second rotor part 4 has a trapezoidal groove at the location on end face 8 oppositely situated from the trapezoidal geometry, so that labyrinth seal 6 is formed by the intermeshing trapezoidal geometries in the assembled state. Besides a trapezoidal geometry for labyrinth seal 6, W- or V-shaped, rectangular, or wave-shaped geometries are also conceivable. The axial extension of labyrinth seal 6 must always be greater than the design-related maximum possible width of gap 18, so that a form-locked connection in the rotational direction may be ensured by labyrinth seal 6 at all times. In addition, the maximum possible width of gap 18 must be set by design in such a way that a sufficient sealing effect may still be achieved with labyrinth seal 6.

At least two pressure medium lines 16 which connect pressure medium lines 14 of camshaft 13 to pressure medium lines 5 of rotor 1 are situated in adapter 10. In the exemplary embodiment described here, adapter 10 has axially extending grooves 15 on its outer surface in the area around pressure medium lines 16 of adapter 10. The extension of grooves 15 in the circumferential direction is greater than the diameter of pressure medium lines 16 of adapter 10 in order to be able to compensate for an offset of pressure medium line 16 of adapter 10 with respect to pressure medium lines 5 of rotor 1 in the circumferential direction. To avoid leaks, groove 15 does not extend to the flank of adapter 10 in the direction of central screw 27; on the side facing away from central screw 27, groove 15 extends up to the flank of adapter 10. A sealing effect is achieved at these locations by a contacting shoulder 29 of second rotor part 4. Due to the extension of groove 15 up to the flank of adapter 10, the pressure medium may flow through pressure medium lines 5 of rotor 1 into pressure chambers 23, 24, despite the axially offset inflow from pressure medium lines 14 of camshaft 13 in a plane, namely, the parting plane. Due to pressure medium lines 5 of rotor 1 which are situated in the parting plane, the pressure medium lines may be formed solely by depressions in end faces 7, 8 of rotor parts 3, 4, which supplement pressure medium lines 5 of rotor 1 which are closed in the circumferential direction when end faces 7, 8 of rotor parts 3, 4 rest against one another.

LIST OF REFERENCE NUMERALS

1 rotor
2 vane(s)
3 first rotor part
4 second rotor part
5 pressure medium line (rotor)
6 labyrinth seal
7 first end face
8 second end face
9 shoulder (central screw)
10 adapter
11 shoulder (adapter)
12 shoulder (camshaft)
13 camshaft
14 pressure medium line (camshaft)
15 groove
16 pressure medium line (adapter)
17 stop
18 gap
19 rotation axis
20 cover
21 stator
22 stator web
23 pressure chamber
24 pressure chamber
25 seal
26 camshaft adjuster
27 central screw
28 central valve
29 shoulder (second rotor part)
30 fastening screw

What is claimed is:

1. A camshaft adjuster for adjusting the angle of rotation of a camshaft, the camshaft adjuster comprising:

a stator drivable by a crankshaft of an internal combustion engine and including multiple radially inwardly protruding stator webs; and a rotor including multiple vanes protruding radially outwardly from a radially inner ring, and an annular space between the stator and the rotor divided by the stator webs into working chambers, the working chambers in turn divided by the vanes into oppositely working pressure chambers;

the rotor being divided into at least a first rotor part and a second rotor part in a parting plane situated perpendicularly with respect to a rotation axis of the camshaft adjuster, a first end face of the first rotor part facing a second end face of the second rotor part, the rotor including pressure medium lines configured for providing a pressure medium to the working chambers, the parting plane of the rotor intersecting at least one of the pressure medium lines of the of the rotor, and the pressure chambers of a first direction of action being separated from the pressure chambers of a second direction of action by at least one seal between the first end face of the first rotor part and the second end face of the second rotor part, the pressure medium lines of the rotor being acted on by pressure, thus forming a gap between the first end face of the first rotor part and the second end face of the second rotor part, the pressure medium flowing from the pressure medium lines of the rotor into the gap, the pressure medium acting on the first end face of the first rotor part and the second end face of the second rotor part in such a way that the first rotor part and the second rotor part are pushed apart in an axial direction.

2. The camshaft adjuster as recited in claim 1 wherein the at least one pressure medium line intersected by the parting plane extends in a radial direction.

3. The camshaft adjuster as recited in claim 1 wherein the at least one seal is formed by a labyrinth seal extending in a radial direction.

4. The camshaft adjuster as recited claim 3 wherein the first rotor part and the second rotor part are connected to one another by a form-locked connection in a rotational direction via the labyrinth seal.

5. The camshaft adjuster as recited in claim 4 wherein an axial extension of the form-locked connection of the labyrinth seal is greater than a maximum axial gap width between the first end face of the first rotor part and the second end face of the second rotor part.

6. The camshaft adjuster as recited in claim 1 further comprising a ring-shaped adapter between the first rotor part and the second rotor part and the camshaft, the ring-shaped adapter including at least two radially extending pressure medium lines, and the at least two radially extending pressure medium lines of the ring-shaped adapter being connected to the pressure medium lines of the rotor via axially extending grooves on a radially outer surface of the ring-shaped adapter.

7. The camshaft adjuster as recited in claim 6 wherein the ring-shaped adapter is braced on the camshaft in the axial direction by an axial central screw.

8. The camshaft adjuster as recited in claim 6 wherein one of the first rotor part and the second rotor part is axially clamped between a shoulder of the ring-shaped adapter and a shoulder of the camshaft, and is connected to the camshaft in a rotatably fixed manner.

9. The camshaft adjuster as recited in claim 1 further comprising a stop for the stator webs on the vanes of one of the first rotor part and the second rotor part connected to the camshaft in a rotatably fixed manner.

* * * * *